US005112249A

United States Patent [19]

Henry et al.

[11] Patent Number: 5,112,249

[45] Date of Patent: May 12, 1992

[54] CONNECTOR LOCKING CLIP

[75] Inventors: Randall R. Henry; Michael R. Sneed, both of Harrisburg, Pa.

[73] Assignee: Amp Incorporated, Harrisburg, Pa.

[21] Appl. No.: 779,451

[22] Filed: Oct. 18, 1991

[51] Int. Cl.[5] ..... H01R 17/04

[52] U.S. Cl. ..... 439/581; 439/92

[58] Field of Search ..... 439/578-585, 439/675, 620, 78, 79, 81, 82, 80

[56] References Cited

U.S. PATENT DOCUMENTS

| | | | |
|---|---|---|---|
| 3,784,955 | 1/1974 | Reynolds et al. | 339/17 R |
| 4,741,703 | 5/1988 | Johnescu et al. | 439/78 |
| 4,795,353 | 1/1989 | Baker | 439/92 |
| 4,884,982 | 12/1989 | Fleming et al. | 439/620 |
| 5,062,811 | 11/1991 | Hackman | 439/78 |

*Primary Examiner*—David L. Pirlot

[57] ABSTRACT

An electrical connector assembly (1) for mounting on a printed circuit board (14) includes an insulative housing (2) and an electrical connector (17), a conductive shell (18), and a ground contact (55) comprises a yoke (56) for receiving passage of the shell (18), with terminals bent to form resilient hooks (63).

6 Claims, 4 Drawing Sheets

CONNECTOR LOCKING CLIP

FIELD OF THE INVENTION

The present invention relates to an electrical connector assembly for mounting on a printed circuit board (PCB). More particularly the invention relates to an electrical connector of coaxial or triaxial construction assembled with electrical contacts for mounting to the surface of a PCB.

BACKGROUND OF THE INVENTION

An electrical connector assembly of triaxial construction and for mounting on a PCB is disclosed by Johnescu et al, U.S. Pat. No. 4,741,703, entitled PCB Mounted Triaxial Connector Assembly. This assembly comprises an insulative body having a base, an electrical connector encircled by the insulative body and having a conductive exterior shell with a disconnect coupling portion, and having an electrical disconnect contact with an electrical disconnect contact portion and an electrical terminal projecting outwardly from the base. The insulative body holds and positions the connector within a hollow interior portion of the body. An opening in the body communicates with the hollow interior portion. The assembly further comprises an electrical contact constructed for insertion along the opening toward the connector and into engagement with the shell, and electrical terminals extending from the insulative body. At least one of these terminals projects outwardly from the base.

Johnescu et al. teaches an electrical contact that includes an elongated holder shaped along its length to conform to and engage against the exterior of the shell. The holder has an open side for receiving passage of the exterior of the shell. The opening in the body is constructed with a cross section to receive passage of the holder transversely of its length and toward the conductor in the hollow interior with the open side of the holder facing the shell.

The holder of Johnescu et al. is a portion of a clip contact which is formed as a unitary piece from a strip of metal of constant thickness and width. The width of the clip is perpendicular to its length and thickness. The clip is curved along its length and transversely of its thickness to provide the holder which is arcuate in shape with an open side of a length less than the diameter of its remainder. Elongated electrical terminals extend from opposite ends of the curved holder. Corresponding portions of the terminals extending from the holder form double back curved resilient springs that oppose each other across an open side of the clip. Tab latching portions are cut from the terminals and are bent to project diagonally form the thickness plane of the terminals. Ends of the terminals are formed with elongated channels by bending elongated edges of the terminals out of the plane of the contact. The ends are constructed for insertion into corresponding apertures of a PCB and resilient spring energy residing in the terminals holds the clip in the apertures until the terminals are joined to the PCB with solder. A connector assembly of triaxial construction is provided with a pair of clips constructed as duplicates of one another.

Desirable would be a connector for a cable assembly which would permit a cable, terminated in a female connection, to be connected via a solderable connector to a PCB. Also desirable would be a connector for a female terminated cable which would provide a compression mating of solder terminals to respective traces of the printed circuit board. Further desirable would be a connector with a retention feature for securing the receptacle contact within the contact passage of the connector housing. The connector of the present invention meets these desired objectives and further provides a structure for targeting the spot connection between solder terminal and trace. With the connector of the present invention, the point of contact of a solder terminal is maintained under compression and at the precise location of desired connection with the trace.

SUMMARY OF THE INVENTION

The present invention relates to an improvement to the clip contact of Johnescu et al. and relates generally to connector assemblies which are mountable to the surface of a PCB having a ground trace. The electrical connector assembly comprises an insulative housing and an electrical connector. The housing has a mounting face and a mating face perpendicular thereto, and has a contact passage extending rearwardly from the mating face to the mounting face. The electrical connector is encircled by the insulative housing and secured in the passage. The electrical connector comprises an electrically conductive shell adapted to be received within the contact passage and includes a compliant ground contact for insertion into holes in the circuit board. Further the connector comprises a dielectric insert having a center bore and adapted to be received and secured within the conductive shell, and a signal carrying electrical disconnect contact pressed into the bore of the insert.

The compliant ground contact comprises a clip having an yoke-shaped portion and elongated electrical terminals. The yoke-shaped portion is shaped along its length to conform to and to engage against the exterior of the electrically conductive shell with an open side for receiving passage of the shell. Each terminal extends from a respective end of the yoke-shaped portion to form double back curved resilient springs that oppose each other across the width of the clip. The end of each terminal is formed into an elongated channel and each channel has an end bent to double back to an angle to the plane of the longitudinal axis of the terminal to form a resilient hook. The hook of the clip provides a pad for soldering to the ground traces of the PCB. Further, bias of the resilient channels of the hook against the conductive aperture walls provides an anchor of the connector assembly to the PCB and conductive contact to the board ground traces.

The contact passage of the housing further comprises a clip-receiving opening communicating with the mounting face of the housing. The clip-receiving opening has an interior of rectangular cross section with a width that slidably receives and confines the width of the clip. The interior is characterized by shoulders which define clearing spaces within the upper interior of the opening above the shoulders. The terminals of the clip may each have a tab latching portion cut from the terminal and bent to project diagonally outward from the terminal thickness plane. The clip is inserted into the clip-receiving opening and secured to the housing with the tab latching portions abutting opposing shoulders of the opening.

The electrically conductive shell may be characterized by a recess of groove form encircling the cylindrical exterior of the shell located in line with the clip receiving opening and accommodating the fit of the yoke of the compliant ground contact to the shell. The yoke-shaped portion of the clip may additionally comprise an arcuate section hemi ellipsoidal in shape and located midway of the arc of the yoke-section. The arcuate section functions to impose a consistent circumferential holding force around the shell.

DETAILED DESCRIPTION OF THE INVENTION

Figure 5:
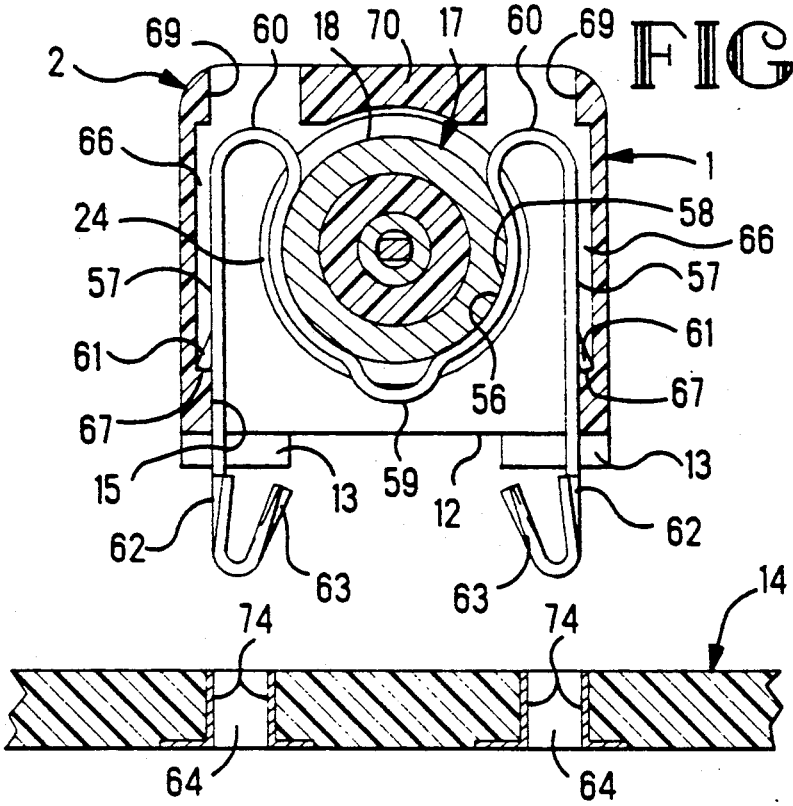
FIG. 5 is an enlarged cross section view of the assembly shown in FIG. 1 as the connector assembly is inserted into the apertures of a PCB.
Figure 6:
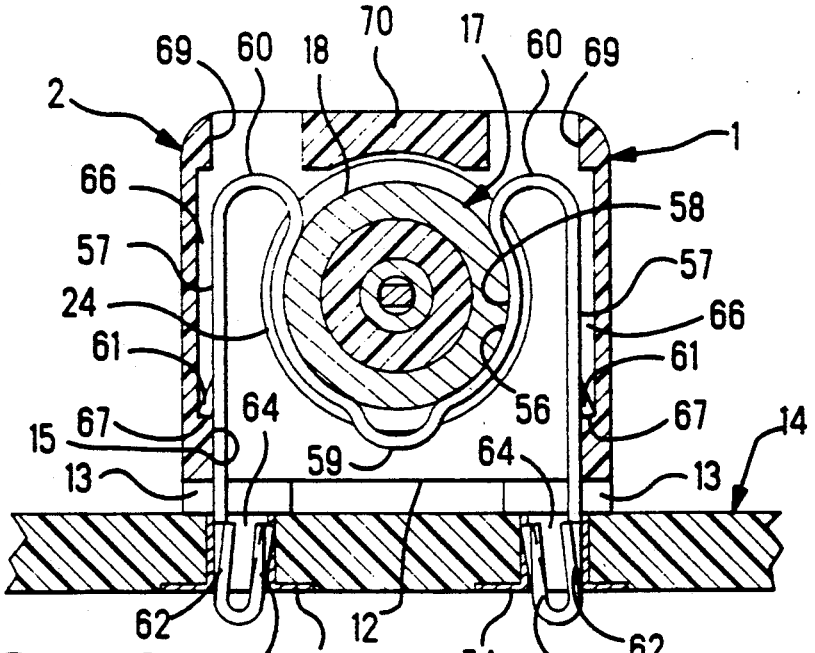
FIG. 6 is an enlarged cross section view of the assembly shown in FIG. 1 showing the connector assembly inserted into a PCB and anchored therewithin by means of the clip of the present invention.

Referring to FIGS. 1, and 2 through 7, there is depicted an electrical connector assembly 1 in accord with the present invention. The assembly 1 includes an insulative housing 2 which may be fabricated, for example, by molding a polymeric plastic material. The housing 2 includes a rectangular portion 3 that is integral with an exterior cylindrical portion 4. The housing 2 has a cylindrical hollow interior portion 5 extending axially through an open end 6 of the rectangular portion 3. The cylindrical hollow interior portion 5 is of reduced diameter and meets annular shoulder 8. Interior portion 5 is further characterized by annular recess 9 and opening 10 at open end 6. Interior portion 5 changes in diameter at the intersection of the rectangular 3 and cylindrical 4 portions of the housing 2 to form shoulder 11. The exterior wall 12 of the housing 2 provides a mounting face having projecting nubs 13 for standing against a PCB 14 as shown in FIGS. 5 and 6. Mounting face 12 is at a right angle with respect to mating face 7. Transverse opening 15 and channel 16 communicate with the exterior wall 12 and the housing interior 5. Channel 16 extends through the end of the housing 2 transversely of the axis of the insulative housing 2 and through the wall 12.

Assembly 1 further includes a coaxial electrical connector 17 having a hollow and electrically conductive shell 18 of stepped cylindrical form for assembly into the mating end 7 of the cylindrical portion 4 of housing 2. The shell 18 has a disconnect coupling portion 19 provided with threaded coupler 20 for disconnect coupling at open end 21 with a complementary electrical connector, not shown. The shell 18 further has an exterior and radially projecting shoulder 22 engaged against interior annular shoulder 11 of housing 2, and rear face 23 engaged against interior annular shoulder 8 to thereby limit the extent of insertion of the shell 18 into the housing 2. The shell 18 further has a recess 24 of groove form encircling its cylindrical exterior and located toward face 23. The shell 18 has a stepped cylindrical interior passageway 25 characterized by annular shoulders 26 and 27.

The coaxial electrical connector 17 further includes a hollow cylindrical insulative liner 28 for within the shell 18. The insulative liner 28 is concentrically surrounded by the exterior conductive shell 18. The liner 28 is in two parts; front part 29 and rear part 30. The part 29 is cylindrical in shape of two sections 31 and 32 of differing diameter. Front section 31 is of a lesser diameter than rear section 32 to form shoulder 33. The front part 29 has a cylindrical through passageway 34 from front end 35 to rear end 36 in which is annular recess 37. Similarly, rear part 30 is cylindrical in shape and of two section 38 and 39 of differing diameters to form exterior shoulder 40. The section 38 of greater diameter is of lesser diameter than the larger diameter section 32 of front part 29 to engage end 36 when the two parts are assembled together to form the insulative liner 28 for insertion into shell 18 as described hereinafter. Within rear part 30 is a cylindrical through passageway 46 having a long relatively slender section 42 from rear end 43 flared at 44 into passageway section 45 of greater diameter which forms a continuous passageway 46 aligned and communicating with the interior passageway 34 of front part 29 when the two parts, 29 and 30, are pressed together during assembly to form the continuous liner 28, again as described following.

Figure 7:
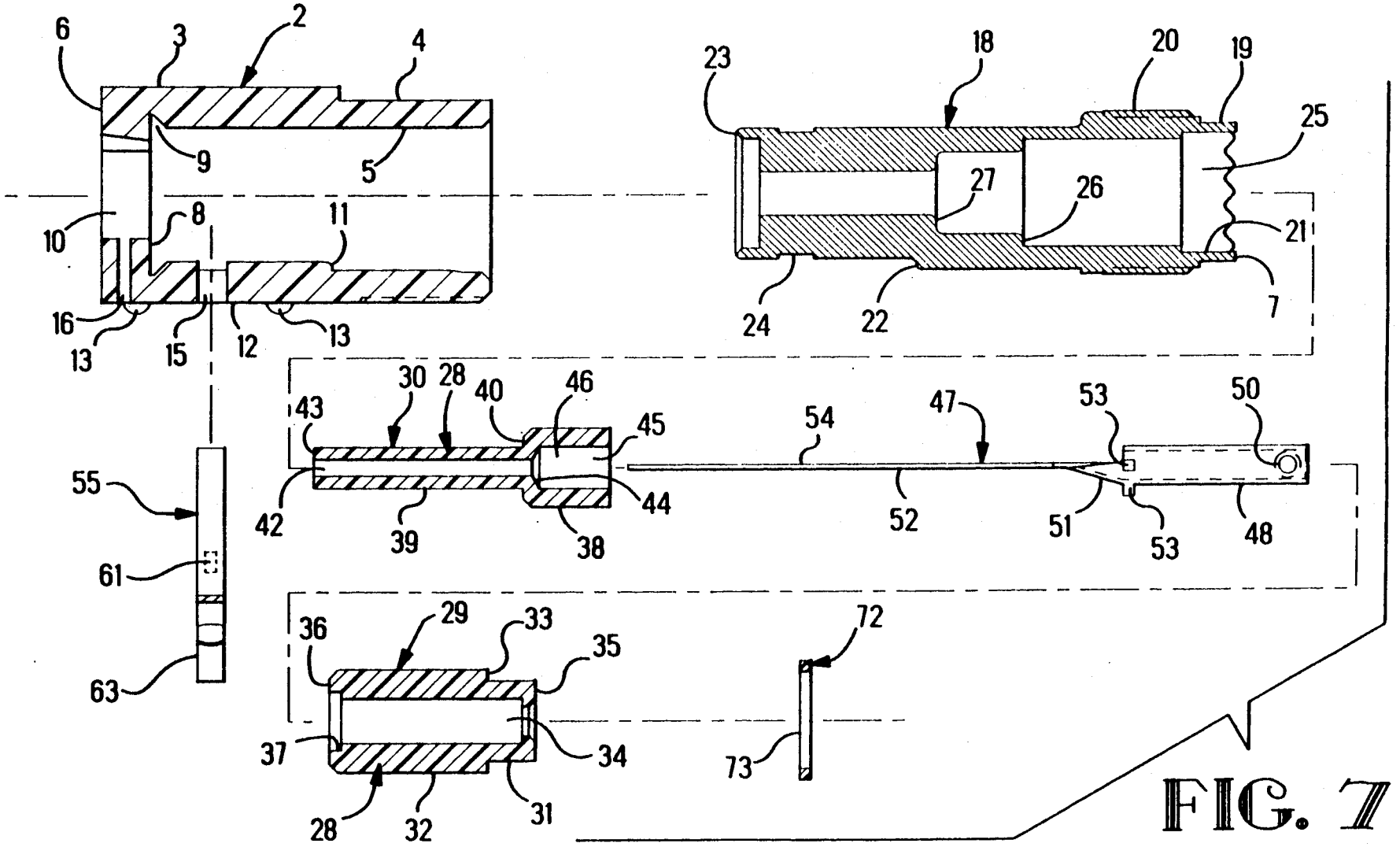
FIG. 7 is a side cut away view of the connector as connector and clip are inserted into the insulative body of the connector assembly.

The assembly 1 further includes a conductive electrical disconnect contact 47, FIG. 7, formed by stamping a metal strip. The disconnect contact 47 has a disconnect contact portion 48 for disconnect connection with a known complementary electrical connector, not shown. The disconnect contact portion 48 is in the form of a hollow cylindrical electrical receptacle formed by bending the strip into a hollow cylindrical shape. The contact 47 is of unitary elongated construction with the receptacle 48 providing for disengagable connection with a blunt ended electrical plug, not shown, which connects by being received within the hollow interior of the cylindrical electrical receptacle 48. Within the interior of the receptacle 48 frictional retention force is provided by raised bumps 50. The disconnect contact 47 has a helix transition area 51 leading from the disconnect portion 48 to an elongated planar straight portion 52. Projection stops 53 are on the end of the disconnect portion 48 where it intersects with the transition area 51. An electrical terminal 54 at the end of the strip is formed by bending elongate edges of the strip out of the plane of the strip to form an elongated channel. The terminal 54 is bent to project at an angle.

Figure 2:
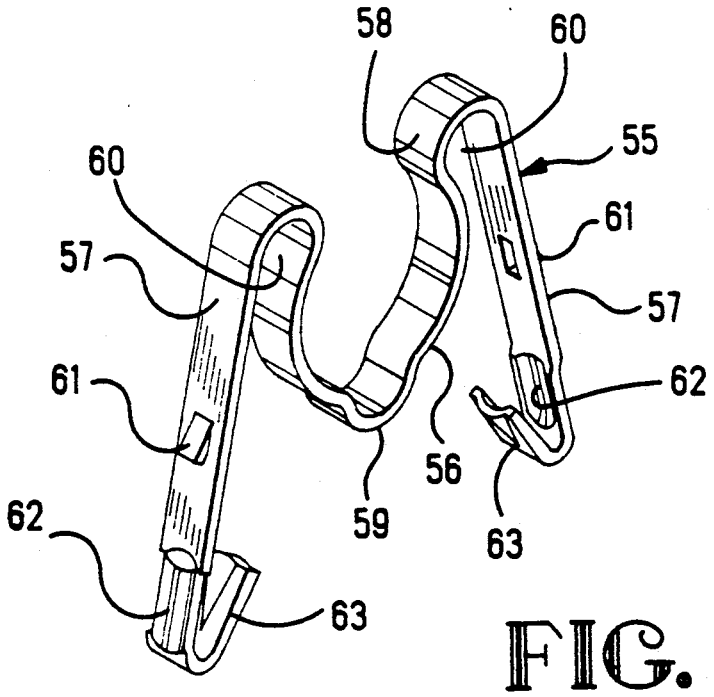
FIG. 2 is a perspective view of the connector locking clip of the present invention.
Figure 3:
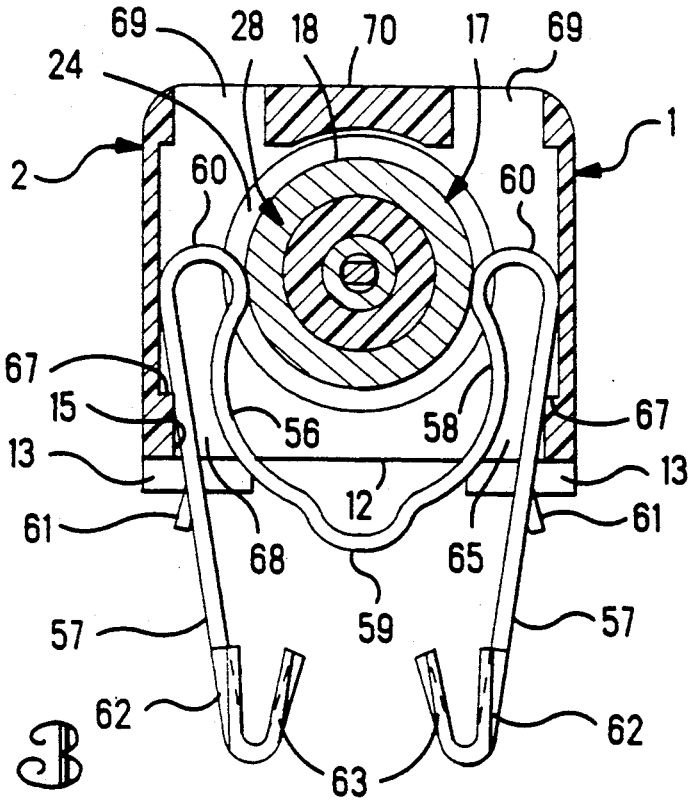
FIG. 3 is an enlarged cross section view of the assembly shown in FIG. 1 and taken generally along the line 4—4 showing the clip of the present invention inserted within the assembly housing.
Figure 4:
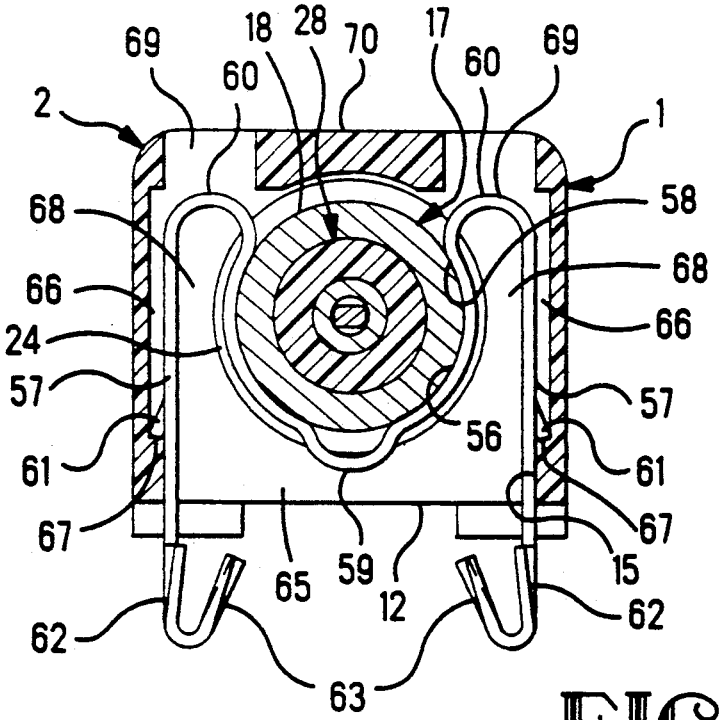
FIG. 4 is an enlarged cross section view of the assembly shown in Figure as the clip is inserted into the connector assembly to secure the outer shell of the connector.

FIG. 2 shows a compliant ground contact 55 adapted for insertion along opening 15 of the housing 2. The compliant ground contact clip 55 is formed as a unitary clip from a strip of metal of constant thickness and width. The width of the clip 55 is perpendicular to its length and thickness. The compliant clip 55 has a yoke-shaped portion 56 and terminals 57, 57. The yoke-shaped portion 56 is shaped along its length to conform to and to engage against the cylindrical exterior of the electrically conductive shell 18 with an open side 58 for receiving passage of the shell 18 during assembly of the connector 17 as hereinafter described. Notably, the yoke-shaped portion 56 has an arcuate outwardly bulged section 59. The terminals 57, 57 are connected to the yoke-shaped portion 56 via arc-shaped sections 60, 60 which extend from opposite sides of the yoke-shaped portion 56, each arc-shaped section 60 is curved to extend the terminals 57 along the sides of the yoke 56. Tab latching portions 61, 61 are cut from the terminals 57,57 and are bent to project diagonally from the thickness plane of each terminal 57. Each terminal 57 extends from the yoke 56 to form double back curved resilient springs that oppose each other across the width of the clip 55. Each terminal 57 at its distal end is formed into an elongated channel 62. Each channel 62 at its end is bent into an angle outward from the plane of the longitudinal axis of the terminal to form a resilient hook 63. As shown in FIGS. 5 and 6, the hooks 63, 63 are constructed to be partially contracted by deflection upon insertion into corresponding apertures 64, 64 of the PCB 14 with resilient spring energy residing in the hooks 63, 63 to expand them tightly in engagement with sides of the apertures 64,64 hold the terminals 57, 57 in the apertures 64, 64 until the terminals 57, 57 are joined to the PCB 14 with solder, not shown.

FIGS. 1, 3, 4, 5, 6 and 7 show the construction of corresponding opening 15 into which a clip 55 is inserted to establish an electrical connection with the shell 18. The opening 15 communicates with the mounting wall 12 of the housing 2 and has an interior 65 of rectangular cross section with a width that slidably receives and confines the width of the clip 55. The clip 55 is inserted in the opening 16 and moved toward the shell 18 with the open side 58 of the yoke 56 facing the shell 18. The terminals 57, 57 pivot toward each other during insertion, deflecting the terminals 57, 57 and storing resilient spring energy therein. The interior 65 of the opening 16 has clearance spaces 66 defined between the interior 65 of the opening 16 and corresponding terminals 57, 57 from the yoke 56 to the tab latching portions 61, 61. The clearance spaces 66 allow for resilient flexure of the terminals 57, 57 away from each other such that the open side of the yoke 56 is lengthened in response to passage of the shell 18 through the open side 58 and into the confines of the yoke 56. After passage of the shell 18, the terminals 57, 57 move toward each other to urge resiliently against the shell 18 in opposing directions, and to close the yoke 56 frictionally in engagement on the exterior of the shell 18. Arcuate section 59, hemi ellipsoidal in shape, insures that the yoke 56 imposes a consistent circumferential holding force around the barrel of shell 18. The opening 15 comprises interior shoulders 67, 67 provided at the intersection of the clearance spaces 66, 66 with the remainder of the interior 68 The latching tabs 61, 61 of respective terminals 57, 57 project against respective shoulders 67, 67 to retain the clip 55 in the opening 16 and to resist removal of the clip 55 from the opening 16. The clearance spaces 66, 66 communicate with corresponding passageways 69, 69 extending to the exterior 70 of the housing 2 and serving as access for a tool blade, not shown, for deflection of the latching tabs 61, 61 away from the shoulders 67, 67 to disengage the clip 55 from the housing 2 and to permit withdrawal of the clip 55 from the opening 10. Further shown in FIGS. 3, 4, 5 and 6 is annular exterior recess 24 of the shell 18 with a diameter conforming to the yoke shape 56 of the clip 55. The recess 24 has a width to receive and conform to the width of the clip 55.

With reference to FIG. 7, the connector 1 is assembled by first inserting rear part 30 of liner 28 into the open front end 7 of shell 18 until seated into the shell 18 with exterior shoulder 40 abutting annular shoulder 26 and rear end 43 extending to outside of the open rear end 23 of the shell 18. The disconnect contact 47 is inserted concentrically into the hollow interior 45 of the rear part 30 of the cylindrical dielectric liner 28 to the point where stops 53 abut the front end of the rear part 30 thereby limiting further insertion. The front part 29 of the liner 28 is then inserted concentrically within the front end 21 of shell 18 along passageway 25 to seat against annular shoulder 27 with annular recess 37 fitted to stops 53 of the disconnect contact 47 thereby capturing the contact 47 between the two parts, 29 and 30, of the liner 28. Retaining ring 72 is provided with opening 73 for retention of the liner 28 and contact 47 within the shell 18. The ring 72 is fitted over the disconnect coupling portion 19 of the shell 18 with the shell 18 projecting through the ring opening 73.

Figure 1:
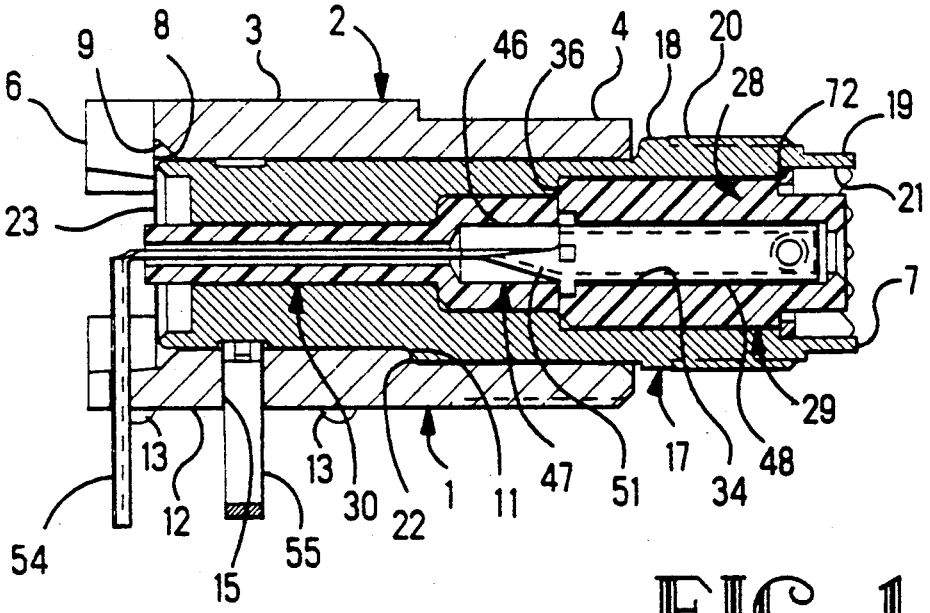
FIG. 1 is an enlarged longitudinal section view of an electrical connector assembly of coaxial configuration of the present invention.

The liner 24 is assembled to the housing 2 by insertion into the open mating end 7 of the housing 2, and concentrically within the cylindrical hollow interior portion 5. After the liner 24 is inserted, the terminal 54 of the contact 47 is bent as shown in FIG. 1 to project at a right angle to the longitudinal axis of the disconnect contact portion 48 and the elongated portion 52 of the contact 47 and as the rear end 23 of the shell 18 comes to rest against the shoulder 11 of the housing 2 the electrical terminal end 54 of the conductive electrical disconnect contact 47 extends from within the interior passageway 25 of the shell 18 and is disposed within the channel 16 of the housing 2.

Referring to FIGS. 1 through 7, Clip 55 is inserted in the opening 10 and moved toward the shell 18 with the open side 58 of the yoke 56 facing the shell 18 barrel. The terminals 57, 57 pivot toward each other during insertion, deflecting the terminals 57, 57 and storing resilient spring energy therein. The terminals 57, 57 flex away from each other such that the open side 58 of the yoke 56 is lengthened to permit passage of the shell 18 through the open side 58 and into the confines of the yoke 56 which nestles into the annular recess 24. After passage of the shell 18, the terminals 57, 57 move toward each other to urge resiliently against the shell 18 in opposing directions, and to close the yoke 56 frictionally in engagement on the exterior of the shell 18. The resilient spring energy urges the terminals 57, 57 to pivot away from each other and to impinge opposite sides of the shell 18 interior with the latching tabs 61, 61 of respective terminals 57, 57 projecting against respective shoulders 67, 67. The tab latching portions 61, 61 are cut from the terminals 57, 57 of the clip 55 and are bent to project diagonally from the thickness plane of the terminals 57, 57.

The assembly 1 is connected to a PCB 14 by the insertion of the electrical terminal 54 of the conductive electrical contact 47 and the electrical terminals 57, 57 of clip 55 into respective board apertures. FIGS. 5 and 6 show insertion of the clip terminals 57, 57 into apertures 64, 64. The apertures 64, 64 are plated 74, 74, as shown in FIGS. 5 and 6, to provide electrical conductivity. The platings 74, 74 are extensions of the PCB 14 grounding traces, not shown. As the terminals 57, 57 are pressed into respective apertures 64, 64, hooks 63, 63 are compressed by the walls of the apertures 64, 64 to create a resilient spring energy that urges the hooks 63, 63 against the platings 74, 74 of the apertures 64, 64. The force of the hooks 63, 63 against the aperture 64, 64 walls retains the terminals 57, 57 and correspondingly the clip 55 and the housing 2 of the connector assembly 1 to the surface of the PCB 14. In this manner the clip 55 accomplishes three functions. The clip 55 serves as a mechanical retention means for the connector assembly 1 through the snap-in feature of the clip hooks 63, 63. The clip 55 provides an electrically conductive grounding contact between the conductive shell 18 and the ground traces of the PCB 14. Finally, the clip 55 serves as a retention mechanism for holding the conductive shell 18, and consequently the electrical connector 17, within the housing 1 of the electrical connector assembly 1.

We claim:

1. An electrical connector assembly for mounting on a printed circuit board having a ground trace comprising; an insulative housing having a mounting face and a mating face perpendicular thereto, said housing having a contact passage extending rearwardly from said mating face to said mounting face; and an electrical connector encircled by the insulative housing and secured in the passage and comprising; an electrically conductive shell adapted to be received within the contact passage and including a compliant ground contact for insertion into apertures in the circuit board, a dielectric insert having center bore and adapted to be received and secured within said conductive shell, and a signal carrying electrical disconnect contact pressed into the bore of said insert, wherein said compliant ground contact comprises:

a clip having an yoke-shaped portion and elongated electrical terminals, the yoke-shaped portion shaped along its length to conform to and to engage against the exterior of the electrically conductive shell with an open side for receiving passage of the shell, and each terminal extending from a respective end of the yoke-shaped portion to form double back curved resilient springs opposing one another across the width of the clip, the end of each terminal formed into an elongated channel and each channel having an end bent to an angle to the plane of the longitudinal axis of the terminal to form a resilient hook.

2. The connector of claim 1 wherein the yoke-shaped portion of the clip comprises an arcuate section hemi-ellipsoidal in shape and located midway of the arc of said yoke-section to impose a consistent circumferential holding force around the said shell.

3. The connector of claim 1 wherein the contact passage of the housing further comprises a clip-receiving opening communicating with the mounting face of the housing.

4. The connector of claim 3 wherein the clip-receiving opening has an interior of rectangular cross section with a width that slidably receives and confines the width of the clip, said interior characterized by shoulders which define clearing spaces within the upper interior of the opening above said shoulders.

5. The connector of claim 4 wherein the terminals of the clip each has a tab latching portion cut from the terminals and bent to project diagonally outward from the terminal thickness plane and wherein the clip is inserted into the clip-receiving opening and secured to the housing with the tab latching portions abutting opposing shoulders of said opening.

6. The connector of claim 3 or 5 wherein the electrically conductive shell is characterized by a recess of groove form encircling the cylindrical exterior of the shell located in line with the clip receiving opening and accommodating the fit of the yoke of the compliant ground contact to the shell.

* * * * *